United States Patent [19]

Venäläinen

[11] Patent Number: 4,848,136

[45] Date of Patent: Jul. 18, 1989

[54] CAR BODY RECTIFYING MEANS

[75] Inventor: Olavi Venäläinen, Kuopio, Finland

[73] Assignee: Auto Robot Finland Ky, Finland

[21] Appl. No.: 142,859

[22] PCT Filed: May 27, 1987

[86] PCT No.: PCT/F187/00073

§ 371 Date: Dec. 29, 1987

§ 102(e) Date: Dec. 29, 1987

[87] PCT Pub. No.: WO87/07191

PCT Pub. Date: Dec. 3, 1987

[30] Foreign Application Priority Data

May 28, 1986 [FI] Finland ..... 862265

[51] Int. Cl.[4] ..... B21D 1/14

[52] U.S. Cl. ..... 72/447; 72/705

[58] Field of Search ..... 72/457, 705, 447

[56] References Cited

U.S. PATENT DOCUMENTS

| | | | |
|---|---|---|---|
| 2,576,544 | 11/1951 | Smith | 72/388 |
| 2,645,267 | 7/1953 | Elam | 72/705 |
| 4,516,423 | 5/1985 | Reich | 72/705 |
| 4,542,636 | 9/1985 | Wright | 72/705 |
| 4,555,927 | 12/1985 | Grace | 72/447 |
| 4,586,359 | 5/1986 | Parks | 72/302 |

FOREIGN PATENT DOCUMENTS

| | | | |
|---|---|---|---|
| 0065942 | 12/1982 | European Pat. Off. . | |
| 0163216 | 5/1985 | European Pat. Off. . | |
| 2038362 | 2/1972 | Fed. Rep. of Germany . | |
| 2145992 | 3/1973 | Fed. Rep. of Germany . | |
| 3136478 | 3/1983 | Fed. Rep. of Germany | 72/705 |
| 53930 | 10/1976 | Finland . | |
| 59348 | 11/1977 | Finland . | |
| 2246322 | 5/1975 | France | 72/705 |
| 365135 | 3/1974 | Sweden . | |
| 389977 | 11/1976 | Sweden . | |
| 426660 | 2/1982 | Sweden . | |
| 1323163 | 7/1973 | United Kingdom | 72/705 |
| 1390393 | 4/1975 | United Kingdom | 72/704 |

*Primary Examiner*—Robert L. Spruill

*Attorney, Agent, or Firm*—Steinberg & Raskin

[57] ABSTRACT

The invention relates to a car body rectifying device (10) having a frame (11), and a rectifying table (12) disposed to be movable in vertical direction relative thereto with attachments (13) on the rectifying table (12) to which the vehicle can be secured. To the rectifying table (12) of the rectifying device or to a frame portion connected therewith and moving along therewith or to a frame portion (b 11) which is fixed with reference to the rectifying table a rectifying unit (40) has in the horizontal plane slidably been connected. The rectifying unit(40) has a frame (41) in turn having a first frame portion (42) and a second frame portion (70) slidably disposed with reference to the first frame portion. The rectifying unit (40) also has components (47,60) for performing rectifying work both on the frame beams of the car and on the body structures themselves, the rectifying forces being directable on the object to be rectified in horizontal as well as vertical direction.

22 Claims, 7 Drawing Sheets

CAR BODY RECTIFYING MEANS

BACKGROUND OF THE INVENTION

The present invention relates to a car body rectifying means comprising a frame, a rectifying table disposed to be vertically movable in relation thereto, and attachments or equivalent on the rectifying table in which the vehicle is fixable.

Such car body rectifying means are known in the art in which the car is driven onto the rectifying table and clamped with skirt attachments, and lifted to desired height. In rectifying means of prior art, the rectifying work has been arranged to take place with the aid of rectifying tools provided on vertical supporting arms. By moving the car, fixed with the skirt attachments of the rectifying table in the vertical direction, such vertical movement has been utilized in the rectifying work itself. It has been possible to move the vertical supporting arms, as is disclosed in the assignee's earlier Finnish Pat. Nos. 59348 and 53930, by moving telescopic beam arrays. In apparatus designs of prior art, rectifying operations have been easy to accomplish specifically in the case of a car's body structures. It may be held forth as a drawback of existing apparatus designs that the rectifying is substantially confined to the body structures of the car. Rectification of the chassis beams themselves cannot be satisfactorily performed with apparatus designs of prior art.

Such rectifying means are also known in the art which have jigs for various parts of the car chassis and in which the chassis structure of the car is not altered when rectifying action is directed on the remaining part of the body. These jigs are meant to maintain in correct position various parts of the car; they are not intended to carry out any rectifying work.

SUMMARY OF THE INVENTION

The object of the present invention is a car body rectifying means by which rectification of the car body's frame beams can be conveniently performed and with the aid of which furthermore the rectifying work on the upper body structures of the car body can be carried out. It is a further object of the invention to provide car body rectifying means which enable performing of the rectifying work with simple, and therefore advantageous, apparatus arrangements.

The means of the invention is mainly characterized in that to a frame component which is stationary in relation to the rectifying table of the rectifying means or to a frame component therewith associated and moving along therewith, or to the rectifying table, has been attached, movably in a horizontal plane, a rectifying unit, this rectifying unit comprising a frame consisting of a first frame portion and a second frame portion which has been disposed to be movable in relation to said first frame portion, and said rectifying unit comprising implements for performing rectifying work both on the chassis beams of the vehicle and on the body structures themselves, the rectifying force being directable to act on the object under rectification in horizontal as well as vertical direction.

The other characteristic features of the invention described below.

The means of the invention operates like a jig, that is, it holds the object in place, but it also executes rectifying movements in every direction, meaning that it takes a hold on the damaged part and moves it into its proper position, where it can be locked, whereafter the rectifying work may proceed with reference to another object. In the means of the invention, many of the rectifying movements can be produced using one single cylinder, by the aid of which the rectifying head performing the rectifying work can be made to move in the longitudinal and transversal directions and, furthermore, from the rectifying table rectifying forces are derived for the chain of the rectifying jib. The design of the invention is advantageous and efficient.

Numerous advantages are gained with the apparatus design of the invention. The rectifying unit of the invention is easy to attach and to detach, whereby it becomes possible to move the rectifying unit from one to the other of the rectifying means. The rectifying unit of the invention is functionally simple. It is possible by rotating a circular plate to direct the rectifying forces to act in desired directions on the points requiring rectification. By defining the position of the pulling implement in relation to the circular plates, the rectifying forces that are transmitted can be influenced. The longitudinal and transversal movement of the rectifying unit allows for rectifying works in desired planar directions.

BRIEF DESCRIPTION OF THE DRAWINGS

The invention is described in detail in the following, referring to certain advantageous embodiments of the invention, presented in the figures of the adjoined drawings, but to which the invention is not meant to be exclusively confined.

DESCRIPTION OF THE PREFERRED EMBODIMENTS

Figure 1:
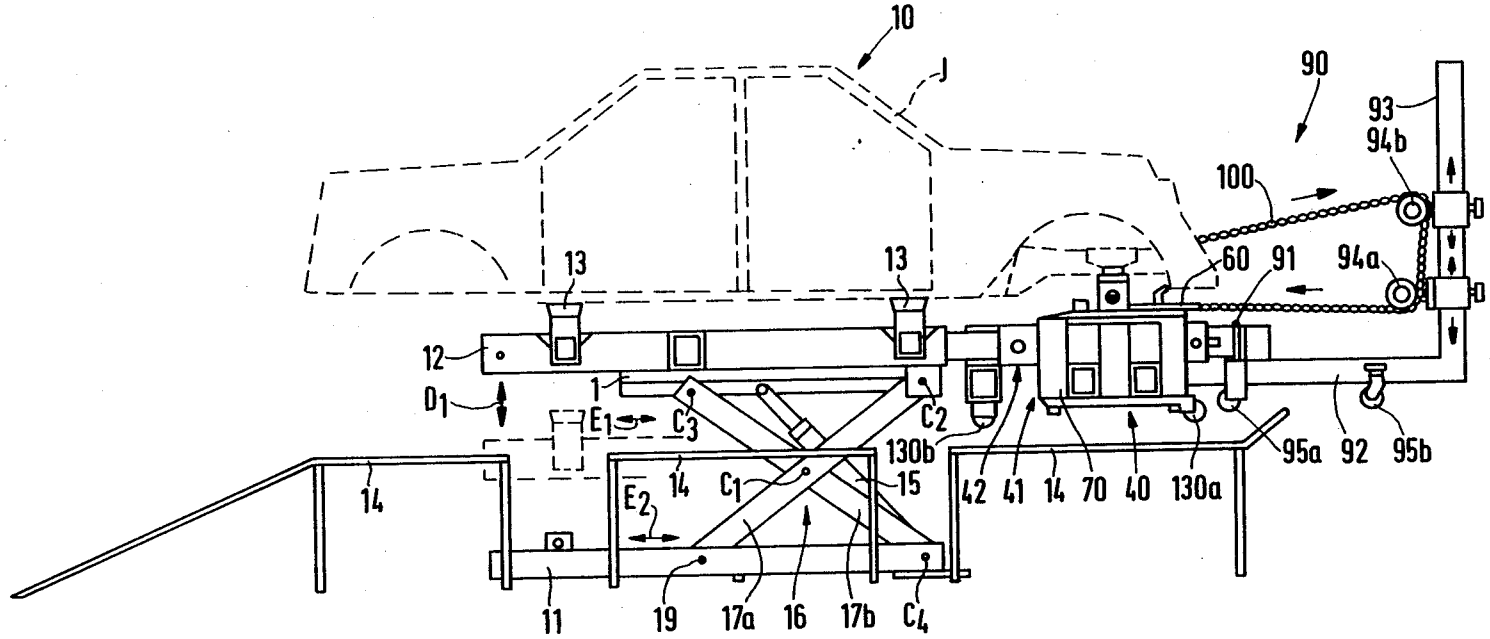
FIG. 1 illustrates a car body rectifying means according to the invention, in elevational view. The vehicle has been presented with dotted lines in the figure.
Figure 2:
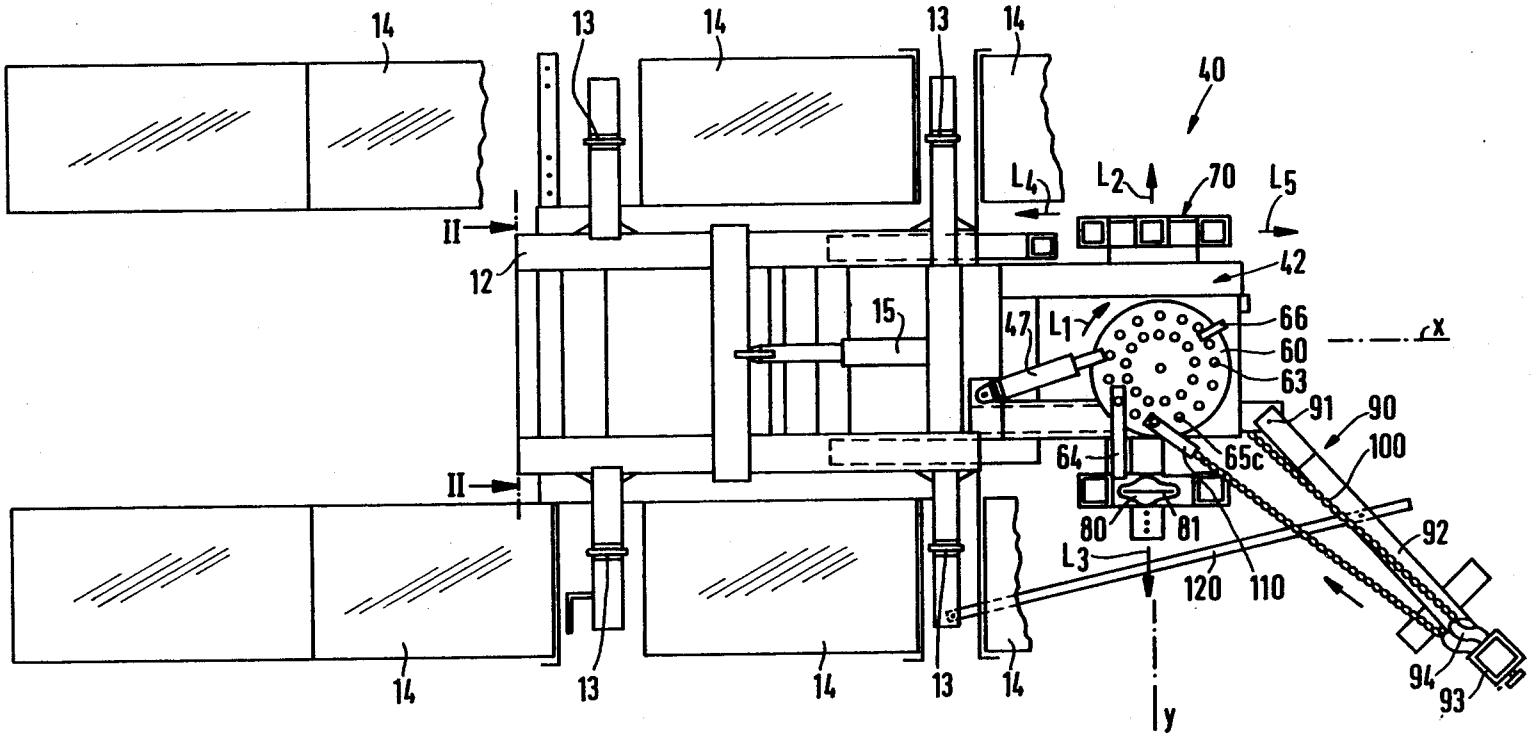
FIG. 2 the same means are presented in top view.

In FIG. 1 is depicted a car body rectifying means 10 according to the invention, in elevational view, and in FIG. 2 the means of FIG. 1 is presented in top view. The rectifying means 10 comprises a frame 11 and a rectifying table 12 disposed to be movable in relation thereto. The rectifying table 12 has been disposed to move substantially vertically, as indicated by the arrow $D_1$. The rectifying table 12 comprises skirt attachments 13 or equivalent.

The vehicle J can be driven onto the rectifying table 12, and the vehicle can be fastened on the rectifying table 12 with the skirt attachments 13. The skirt attachments 13 may advantageously be located on cantilever beams adjoining the rim of the rectifying table 12. The skirt attachments 13 may be gripping members with screw action, in which case the skirt of the car can be introduced between the gripping jaws. The jaws of the skirt attachment are openable and closable by a rotating screw. The vehicle can be driven onto the rectifying table 12 over driving plates 14. The rectifying table 12 can be moved with the aid of lifting means 15. The lifting means 15 are advantageously a hydraulic cylinder, are coupled at one end to the frame 11 and at the other end to the lifting mechanism 16. The lifting mechanism is further fixedly connected to the rectifying table 12 or to the frame portion therewith connected. The lifting mechanism 16 is advantageously a shearlegs mechanism, comprising at least two lifting arms 17*a* and 17*b*. The upper end of the lifting arm 17*b* has been disposed to move substantially horizontally, as indicated by arrow $E_1$, in relation to the beam 1. The lower end of the lifting arm 17*a* has been pivoted with the axle 19 turnably to a sliding rod 18. The sliding rod 18 comprises a plurality of receiving recesses 20. The sliding rod 18 has been disposed to travel in the sliding guide 22 in horizontal direction as indicated by arrow $E_2$. The lifting arm 17*a* has been pivoted at its lower end turnably in relation to the frame 11 on the axle 19. The lifting arm 17a is at its centre turnably pivoted on the axle $C_1$ and to turn in relation to the arm 17*b*, and at its upper end it is pivoted to turn on the axle $C_2$ in relation to the horizontal beam 1 connected with the rectifying table. Likewise, the arm 17*b* has been pivoted at its upper end to turn in relation to the horizontal beam 1 on the axle $C_3$ and at its lower end, in relation to the frame 11 on the axle $C_4$.

The rectifying means of the invention further comprise the end unit 90 shown in FIGS. 1 and 2, which has been disposed to turn in the horizontal plane about the axle 91. The end unit 90 comprises two substantially perpendicular beams a horizontal beam 92 and a vertical beam 93 attaching thereto. The end unit 90 further comprises a pulling implement, advantageously a wire rope 100, and guide rollers 94. The guide rollers 94*a* and 94*b*, or trundles, are detachably and movably mounted on the vertical beam 93 and they can be positioned in various locked positions on this beam. The end unit 90 further comprises transport rollers 95 disposed on the bottom of the horizontal beam 92, and the unit 90 may be moved about the shop floor, carried by these rollers. The ancillary unit 90 may be attached, when doing a given job, in a given position with the aid of the fixing arm 120 shown in FIG. 2. The arm 120 has been disposed to attach to the unit 90 and to the rectifying table 12. The end unit 90 comprises at least one horizontal beam 92 and at least one vertical beam 93 substantially perpendicular thereto. On the vertical beam 93, at least one guide roller 94 or equivalent is disposed, over which a wire rope 100 or equivalent has also been disposed to be carried or supported when directed from the turning plate 60 to structures of a car body.

As taught by the invention, the car body rectifying means 10 comprise a rectifying unit 40 detachably attachable to the frame 11. The rectifying unit 40 comprises a frame 41, which further consists of a first frame portion 42, disposed to be movable substantially in the direction of the longitudinal axis X of the rectifying means, and of a second frame portion 70, disposed to be movable substantially transversally to said first frame portion 42. Said second frame portion 70 has been disposed so that it can be moved in relation to the first frame portion 42, and advantageously substantially transversally to its central axis X, in the direction of the Y axis. The longitudinal axis and central axis of the rectifying means is denoted with X in the figures, and the axis which is perpendicular thereagainst, with Y. The rectifying unit 40 can be moved into contact with the rectifying table 12 of the rectifying means 10 or with the frame portion 11 therewith associated with the aid of wheels 130*a* and 130*b* or equivalent.

To the first frame portion 42 has been pivoted a turning table 60, which can be rotated in relation to the frame portion 42 with the aid of action means 47. The turning table 60 presents a plurality of receiving recesses 63 in which the end of the wire rope 100 can be fixed; this is the way in which the force is carried onward from the turning table to the points requiring rectification. To the second frame portion 70, which is movable in relation to the frame portion 42, can be attached a rectifying head 80; thus, since the frame portion 42 may be moved in the direction of the longitudinal axis X and also the frame portion 70 may be moved at right angles thereto, it becomes possible to rectify the chassis structures of the car with the rectifying head 80 in any desired direction. The rectifying head 80 carries a gripping member 81, whereby the car can be fixed with the gripping member 81 and consequently also rectifying work can be done on the chassis structure in addition to mere steadying. The grip member 81 is movable up and down, whereby the grip member has all options of movement. The action means 47 may be a hydraulic cylinder which is, at one end, pivoted onto the turning plate 60, and at the opposite end, pivoted onto a sliding beam 46 of the first frame portion 42. The turning plate 60 is preferably a circular plate, located substantially in a plane of the rectifying table 12. Furthermore, the rectifying unit 40 may comprise at least one receiving recess d in the second frame portion 70, in which the separate, vertically-positioned rectifying head 80 can be installed.

Figure 3A:
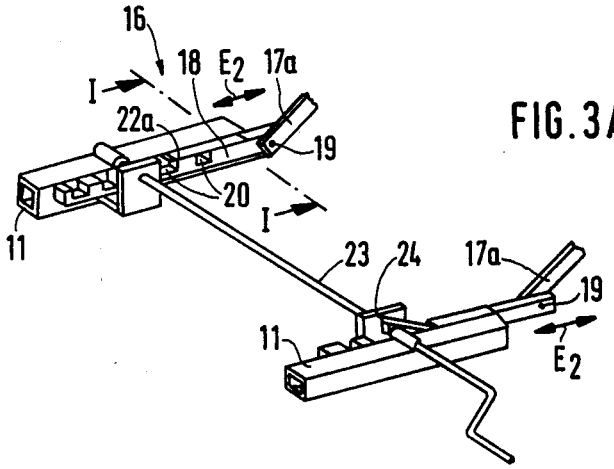
FIG. 3A is presented the design of the lower end of the shearlegs mechanism which is part of the lifting means of the car body rectifying means according to the invention, in axonometric perspective.
Figure 3B:
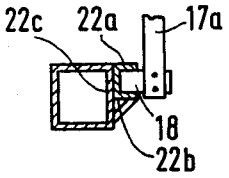
FIG. 3B is presented a projection following the line I—I on FIG. 3A and viewed in the direction of the arrows.
Figure 3C:
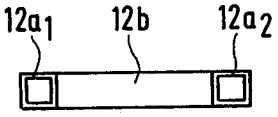
FIG. 3C is presented a projection of the end of the frame of the rectifying means of the invention, viewed in the direction of arrows II—II in FIG. 2.

In FIGS. 3A and 3B is schematically presented the design of the lifting mechanism 16. The sliding rod 18 has been fitted to run in a sliding guide 22. The sliding guide 22 comprises an upper retention surface 22*a*, a lower retention surface 22*b* and a lateral retention surface 22*c*. This sliding guide design having an U-shaped cross section ensures that the sliding rod 18 keeps in the sliding guide 22 even in the event that the vehicle is unevenly loaded as it rests on the rectifying table 12, or on the whole when the first lifting arm 17*a* of the shearlegs assembly 16 exerts forces in different directions on the sliding rod 18, either tending to lift the sliding rod up in the sliding guide 22 or tending to press it down towards the bottom of the sliding guide 22.

The sliding rod 18 is provided with a plurality of recesses 20. The detent rod 23 with the detent body 24 thereon can be adjusted to be in a position such that the detent body 24 lodges in a recess 20. Thus a positively secured position of the shearlegs assembly and a positively secured position in height of the rectifying table 12 are ensured. The sliding guide 22 has been disposed on the longitudinal beam of the frame, at its upper edge and on its side face. The sliding rod 18 is being held in the sliding guide 22 as the lifting arms 17*a* tends to lift the sliding rod 18 or to press it down. In this embodiment of the invention there are two first lifting arms 17*a* as shown in FIG. 3A, and similarly there are two second lifting arms 17*b*. Such a design of the lifting mechanism is also conceivable in which the lifting arms 17*a* and 17*b* each consist of a single plate component. The upper end of one of the lifting arms 17*a* and 17*b* and the lower end of the other have been disposed to be horizontally slidable, as indicated by arrow E.

Figure 4:
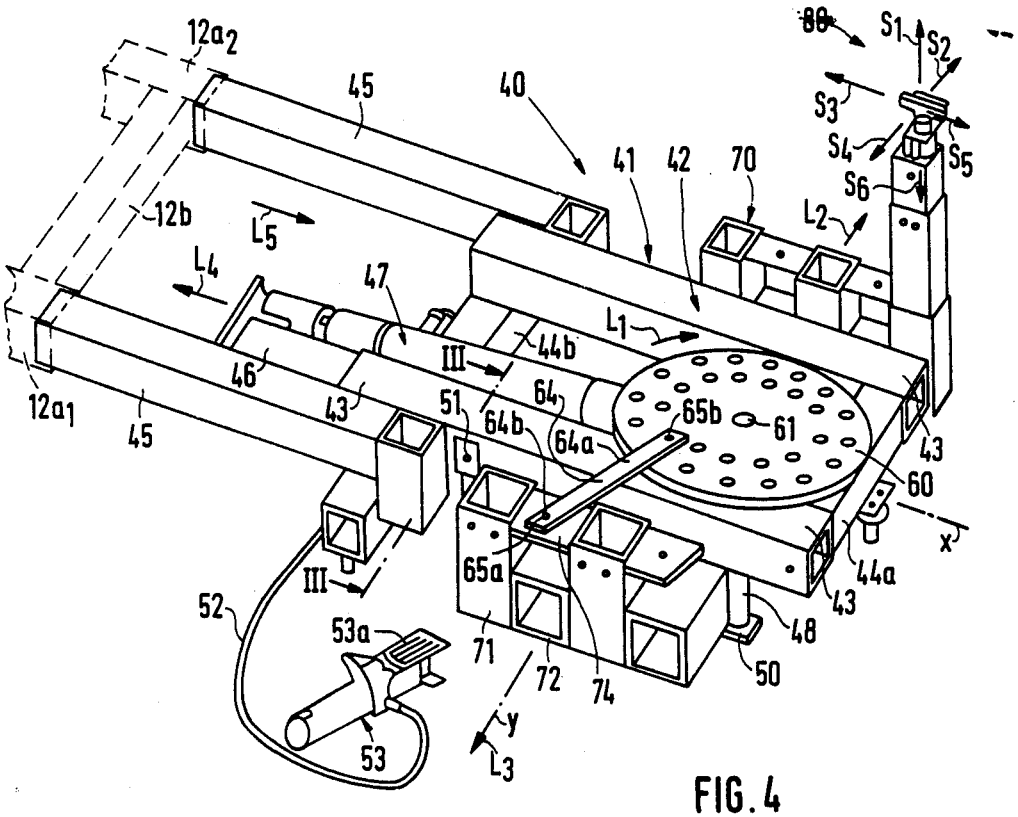
FIG. 4 is presented the rectifying unit of the invention in axonometric projection.
Figure 5:
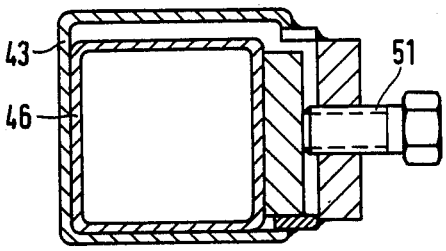
FIG. 5 is presented a section carried along the line III—III in FIG. 4 and viewed in the direction of the arrows.
Figure 6:
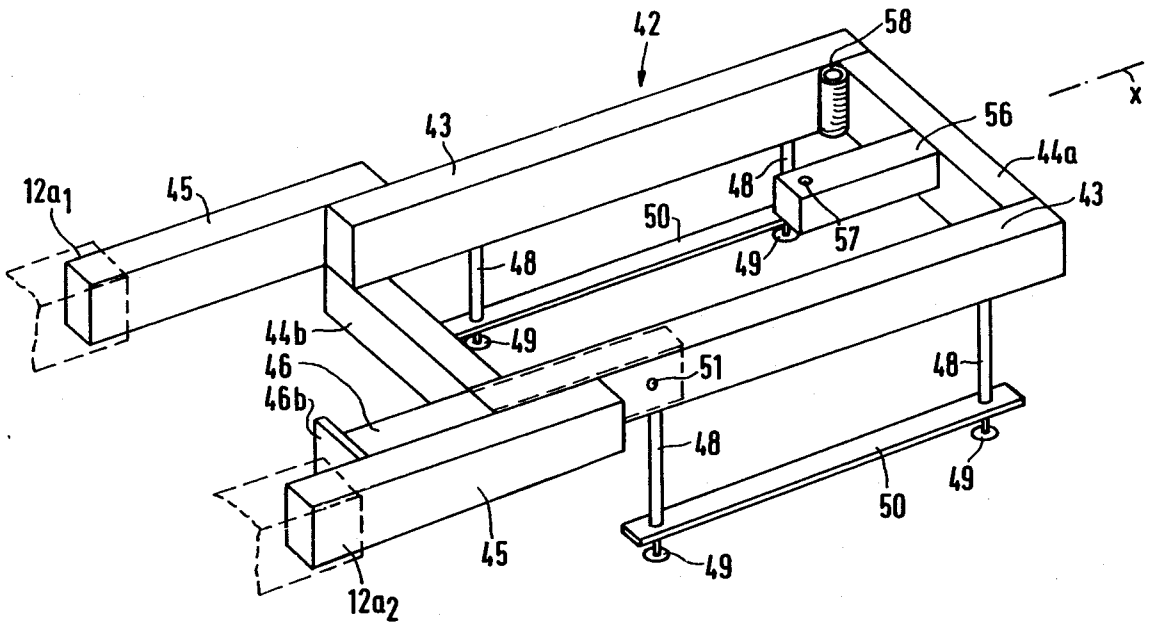
FIG. 6 is presented the first frame portion of the rectifying unit, in axonometric perspective.
Figure 7:
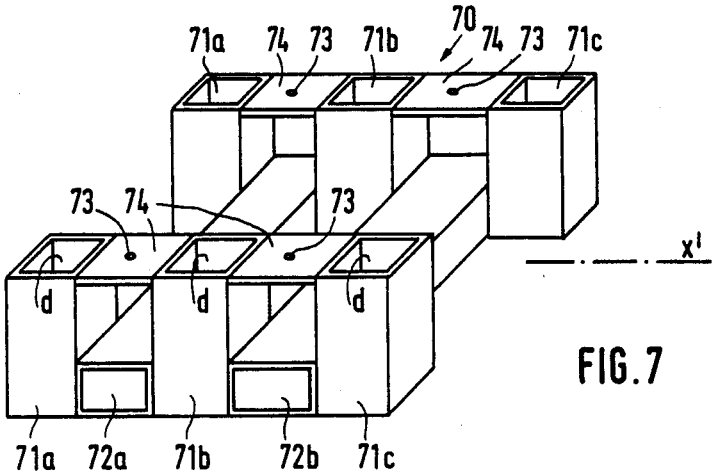
FIG. 7 is presented the second frame portion of the rectifying unit, in axonometric perspective.

In FIG. 4 is presented, in axonometric projection, the rectifying unit 40 of the invention. In FIG. 5 is shown a section, carried along the line III—III in FIG. 4. FIGS. 6 and 7 show separately the frame portion 42 and the frame portion 70, while in FIG. 8 the turning plate 60 is separately shown.

The first frame portion 42, apparent from FIGS. 4 and 6, consists of two beams 43 side by side. The beam 43 is united by a tie beam 44. To one end of each beam 43 has been attached another beam 45 on the side face of the beam 43. The beam 46 is slidable to assume different positions relative to the beams 43 thereabout, and they are securable in desired positions with fixing means 41, advantageously with screws, in relation to each other.

The beams may be corrected by one single frame beam 44*a* or by two beams, in which case the other beam 44*b* is placed at the other end of the beams 43 which is opposite to the beam 44*a*. The beams 45 can be fitted to the rectifying table 12 of the rectifying means 10, in the receiving beams $12a_1$ and $12a_2$ of the unit 40. The unit 40 is slidable into different positions on the beams $12a_1$, $12a_2$, utilizing the telescopic arrangement of the beams $12a_1$, $12a_2$ and 45 in relation to each other.

The frame portion 42 further comprises the clamping part 50 shown in FIG. 6. With the aid of the clamping part 50, advantageously a flat bar iron, the second frame portion 70 can be affixed to the first frame portion 42, and said clamp part 50 at the same time serves as sliding guide for the frame part 70 when the frame part 70 is caused to slide in the direction of the y axis in relation to the frame portion 42. The second frame portion 70 is thus placeable between the beams 43 and the clamp part 50, and screws 49 may be provided to be screwed into the rods 48. By turning the screws 49, the second frame part 70 can be urged against the beam 43, whereby different fixing positions are obtained for the frame part 70. To the transversal beam 44*a* a central beam 56 is attached parallelling the longitudinal axis X, this central beam 56 having a recess 57 to receive the shaft 61 of the plate 60. On the other end of the transversal beam 44*a*, in the corner of the framework, is located a receiving part 58, which advantageously is a tubular part, into which the cotter pin securing the plate 60 in its position to the frame portion 42 can be fitted, whereby the cotter pin can be passed through a hole 63 in the plate 60 and further to enter the receiving part 58.

In FIG. 7 is presented the second frame part 70, separate and in axonometric projection. The frame portion 70 comprises vertical beams 71*a*,71*b* and 71*c*, of which there are three on both sides of the central axis X'. Between the vertical beams 71*a*,71*b* and 71*c*, in their upper part, have been placed intermediate plates 74, which present a receiving recess 73 for a cotter pin or for the rotation pin 65.

Figure 8:
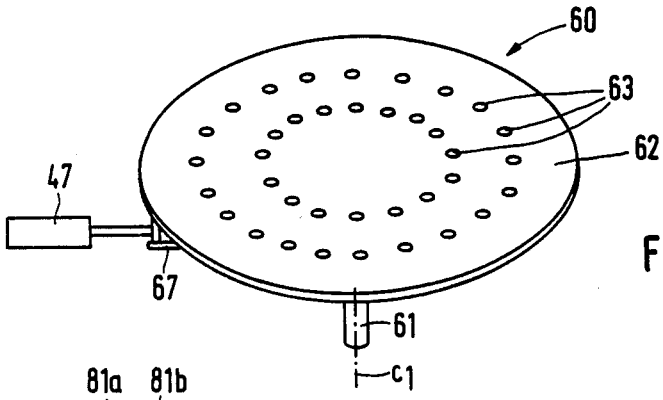
FIG. 8 is presented the turning plate 60 in axonometric projection. In the projection, the action means coupled to the turning plate has been schematically included.

In FIG. 8 is presented, also in axonometric projection, the turning plate 60, and in this presentation has also been included one end of the hydraulic cylinder 47. The turning plate 60 can be joined to the fixing beam 56 for the turning plate 60 provided on the first frame portion 42, in its bearing recess 57. The fixing beam 56 of the turning plate 60 has been centrally fitted to the frame beam 44*a*, substantially at its centre.

As shown in FIG. 8, the turning plate 60 comprises a shaft part 61 and a plate component 62 fixedly pivoted thereto, this latter part being provided with circles of holes at different distances from the axis $c_1$, each circle comprising a plurality of receiving recesses 63, in these receiving recesses being fixable the shaft of a halter or equivalent or a rod 64 causing movement of the second frame portion 70. The turning plate 60 has a plurality of receiving recesses 63, advantageously holes, for attachment of one end of the action means 47 and/or an arm 64 and/or 110 or an equivalent tool. The second frame portion 70 of the rectifying unit 40 is slidable relative to the first frame portion 42 and fixable to the first frame portion 42 is various positions, with fixing means 48, 49, 50. The second frame portion 70 is fixable with reference to the first frame portion 42 in the various positions by clamping a fixing part 50, advantageously a flat bar iron, with a screw fast to the beam 43. Through the holes 63 may also be passed a cotter pin or pin 66 securing the turning plate to the frame portion 42. Said pin 66 can be disposed through the hole 63 into the receiving part 58, in its hole 57. As shown in FIG. 8, the end of the piston rod of the cylider 47 has been fixed with a fixing iron 67 to the turing plate 60. The cylinder is in a fixed position relative to the turning plate 60, but it is so pivoted to the turning plate 60 that angular motion between the turning plate 60 and the end of the cylinder 47 is allowed.

The receiving recesses 63 in the turning plate 60 have been disposed on different radii relative to the axis of rotation 61 of the turning plate 60. The rectifying unit 40 furthermore comprises an arm 64 attachable to the turning plate 60. This arm 64 is additionally attachable by one end to the second frame portion 70 for moving the second frame portion 70 substantially at right angles relative to the first frame portion 42.

The turing plate 60 is most advantageously a circular plate component rotatably carried by its central shaft 61. The turning plate has been disposed to rotate, carried by the shaft 61, relative to the frame 42 about the axis of rotation $C_1$, said rotation being effected by action means, advantageously a hydraulic cylinder, and even more advantageously a single-action hydraulic cylinder with spring return. The action means has been disposed, as already observed before, to attach by one end to the turning plate 60 and by the other end to the first frame portion 42, to its movable frame beam 42, at its end flange 46*b*.

The sliding beam 46 can be affixed to the rectifying table 12, advantageously to the frame beam 12*b*, while the action means 47 are preferably a double-acting hydraulic cylinder.

As taught by the invention, the rectifying unit 40 can be caused to slide relative to the rectifying table 12 of the rectifying means 10 on the beams 12a of its rectifying table. This sliding takes place so that the beams 45 have been fitted to slide telescopically or otherwise in relation to the rectifying table 12 or to the frame portion attached thereto and rising and descending together therewith, and advantageously so that the beams 45 have been fitted to slide in the beams 12$a_1$,12$a_2$ of the rectifying table 12.

Figure 11:
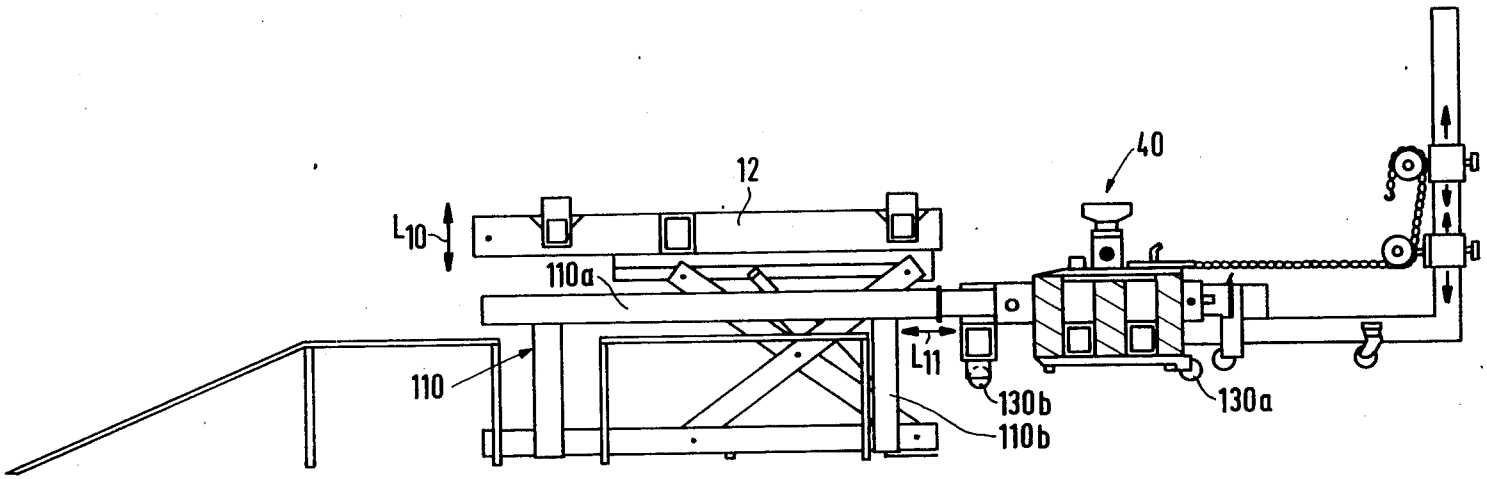
FIG. 11 is presented a second embodiment of the invention in elevational view.

The unit 40 can be lifted along with the rectifying table 12, attached to the rectifying table 12, to different positions in height. The unit 40 is freely slidable relative to the rectifying table 12 in the horizontal direction, and most advantageously in the direction of the x axis. "Sliding" is here understood to mean generally the free motion which the unit 40 may execute relative to the rectifying table 12. The movement may take place in sliding contact between the components 40 and 12, or for instance carried on rollers. The frame 41 of the unit 40, its first frame portion 42 and advantageously the beam 45, may thus comprise sliding guides or sliding surfaces, as in the embodiment of the figure, or it may comprise rotatably carried rollers which carry the unit 40 as it moves relative to the rectifying table 12 or to the fixed frame portion 110 (FIG. 11). The unit 40 is slidable in the horizontal plane substantially below the plane of the car's chassis, and advantageously below the car's chassis structures.

To the hydraulic cylinder 47 pressurized oil is carried through the pressure conduit 52 and with the foot-operated means 53 by depressing the pedal 53*a*. The primary energy, which is compressed air, is supplied to the apparatus under 6 bar operating pressure. The return movement of the piston rod of the hydraulic cylinder 47 has been arranged to take place by spring action. The movable beam 46 of the first frame portion 42 of the rectifying unit 40 is fixable with a fixing element 51 in various positions with reference to the beam 43. When the screw 51 or equivalent is loosened and the relative movement of the beam parts 43 and 46 is enabled, the beam part 46 moves, as indicated with arrow L4, into contact with the transversal beam 12*b* of the rectifying table 12 and only thereafter the hydraulic cylinder begins to act with its force and with the aid of the rectifying head 80 or another equivalent tool on the car body. By tightening the screw 51, the beam 46 can be fixed in a given position relative to the beam 43, and thus relative to the first frame portion 42.

In FIG. 5 is shown the location with reference to each other of the beams 43 and 46, the beam 46 being in the beam 43 and the action between said beams being telescopic. By rotating the screw 51, the beam part 46 can be secured in exact position relative to the beam part 43, and the rectifying head 80 can thus be fixed in various positions also in the direction of the longitudinal axis of the car and of the rectifying means.

FIGS. 1,2 and 4 reveal the mode of operation of the rectifying unit 40 of the invention. As has been observed already, the turning plate 60 can be rotated about the shaft 61, the topside plane of the turning plate 60 being substantially horizontal and being placed substantially in the plane of the rectifying table 12 or in its vicinity and being advantageously placed under the body structure that is being rectified. The turning plate 60 is in the embodiment of the figures a circular plate with a plurality of recesses 63 on several circles which are at different radii from the axis of rotation $C_1$.

In said recesses can be fitted one end of the chain 100, either directly or so that the chain first connects with an intermediate arm 110, this intermediate arm 110 being plate-shaped or rod-shaped the part further connects in pivoted arrangement with said turning plate 60 and with its receiving recess 63 by a cotter pin 65 or equivalent. The force transmitted by the turning plate 60 is the greater the closer to the central axis $C_1$ the end of the chain 100 is placed. Similarly, when it is required with one stroke length of the hydraulic cylinder 47 to produce maximal movement, the chain 100, or another tool, its end is fixed in a receiving recess 63 located as far as possible from the central axis $C_1$.

Similarly, the arm 64 transmitting the movement of the second frame portion 70 is most advantageously fixable so between the turning plate 60 and the second frame portion 70 that nothing but a tension force acts on the arm 64. This is advantageous specifically in view of the durability of the arm 64 because a rod-shaped structure tolerates tension better than compression, the risk of buckling being obvious in the latter case. Therefore when as shown in FIGS. 2 and 4 a movement of the second frame portion 70 is caused in the direction of arrow L2 and the turning plate 60 is rotated in the direction of the arrow L1 clockwise, a tension force acts on the arm 64. When it is desired to impart a motion in the direction of arrow L3, that is in the opposite direction, to said second frame portion 70, the intermediate arm 64 is attached on the other side of the central axis $C_1$ of the apparatus.

The arm 64 is so pivoted to the turning plate 60 and to the second frame portion 70 that its turning motion is enabled both in relation to the turning plate 60 and to the frame portion 70. When the arm, or rod, 64 is fixed by one end 64*a* to the turning plate 60 and by its other end 64*b* to the second frame portion 70 and the action means 47 rotates the turning plate 60 about the shaft 61, as indicated with arrow L1, the second frame portion 70 is displaced parallel to the lateral axis Y in relation to the first frame portion 42. When the staying arm 80 or another equivalent rectifying means is attached to one of the receiving recesses 71*a*,71*b*,71*c* of the frame portion 70, said movement in the direction of the Y axis can be utilized in the rectifying operation, either for staying or in the rectifying work itself.

The chain 100, or another force-transmitting means, may be arranged to pass from the turning plate 60 over the guide rollers 94 of the end unit 90, whereby rectifying work on parts of the vehicle body higher up also becomes possible (FIGS. 1 and 2).

Figure 9:
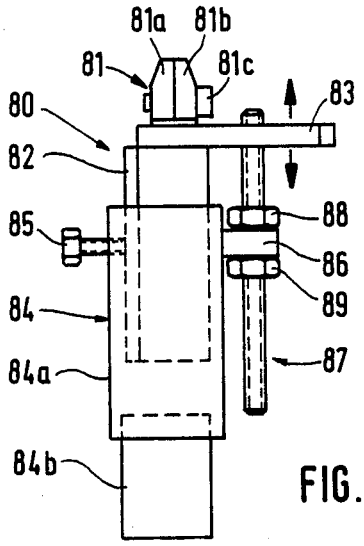
FIG. 9 is presented an advantageous embodiment of the rectifying head in elevational view.

In FIG. 9 is presented an advantageous embodiment of the rectifying head 80 in elevational view. The rectifying head 80 comprises a gripping member 81 with fixing jaws 81*a* and 81*b*, which can be opened and closed with the aid of a screw 81*c*. The gripping member 81 is attached and fixed to the beam 82. Between the gripping member 81 and the beam 82 has been disposed a projecting part 83. The beam 82 has been disposed to be movable in the beam 84 telescopically, and the beam 82 can be fixed in relation to the beam 84 in various positions with the aid of the screw 85. The beam 84 comprises an upper portion 84*a* and a fixing portion 84*b*, attaching to its end and arranged to settle in the second frame portion 70, in one of its receiving recesses 71*a*,71*b* or 71*c*. The rectifying head 80 further comprises a screw 87 disposed to raise and lower the gripping member 81, and thereby the beam 82. The screw 87 has been disposed to pass through a hole in the projection 86 of the beam 84, and the screw 87 is by one end affixed to the projection 83. Nuts 88 and 89 have been placed on the screw 87 and to be located on two sides of the projection 86. By turning the nuts 88 and 89 in opposite directions, the gripping member 81 is raised or lowered, and by reversing these turning directions the direction of movement of the gripping member 81 is also changed. It is thus possible with the aid of the rectifying head 80 to perform also vertical rectifying of a car's chassis structure.

Figure 10:
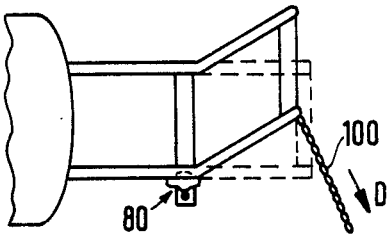
FIG. 10 illustrates the rectifying work performed with the means of the invention. This is a top view, showing a distorted bottom beam of a car in the process of being rectified.

In FIG. 11 is shown the staying which can be done with the rectifying head 80. The rectifying head has been conveyed, as shown in FIG. 10, to contact the side beam of the vehicle. It is thus possible, using the pull halter, to perform the pulling work, illustrated in FIG. 10, in the direction D, and the beam of the vehicle is expediently stayed at the point where it is angulated with the aid of the rectifying head 80.

In an advantageous embodiment of the invention, depicted in FIGS. 1,2 and 4, a force is produced with the hydraulic cylinder 47 in the direction of the arrow L5 entered in FIG. 4. First, the hydraulic cylinder 47 moves the beam 46 in the direction of the arrow L4. When the beam 46 with its end plate hits the rectifying table at its transversal beam part 12*b*, the hydraulic cylinder 47 begins to act on the remaining frame portion of the rectifying unit 40 with a force having the direction of arrow L5. Such an embodiment of the invention is equally possible in which the hydraulic cylinder 47 is a double-acting cylinder. In that case the hydraulic cylinder 47 is attached to the rectifying table 12 of the rectifying means 10, and advantageously so that the end flange 46*b* has holes for screws so that the end flange 46*b* can be affixed to the rectifying table 12 of the rectifying means 10, i.e., to its transversal beam 12*b*. It is possible after such attachment with the hydraulic cylinder also to perform the movement of the first frame portion 42 in the direction of arrow L4, and such movement which requires force, the beams 45 also in this embodiment being freely movable relative to the rectifying table 12 and in its beams 12a along them, or if they are telescopically arranged, in which case the beam 45 has been disposed to move encircling the beams 12*a* of the rectifying table 12.

The rectifying unit 40 can be attached to the rectifying table 12 of the rectifying means 10 with reference to the longitudinal axis x of the rectifying means 10 at the forward and/or rear end, with separate fixing means 12*c* for the rectifying unit 40, advantageously beams, being disposed to be located on the rectifying table 12. The rectifying means 10 may also comprise separate force means for moving the rectifying unit 40 with its frame portions 42, 70 vertically, relative to the rectifying table 12 or to a fixedly positioned frame 110.

In the following is furthermore presented a detailed description of the operation of the apparatus in car body rectifying work. The car is driven, or pulled up onto the rectifying table 12 along the driving plates 14. Next, the chassis attachments 13 are adjusted to be located under the edge of the skirt. Lifting is effected with the hydraulic cylinder 15 until the car is fully carried by the fixing means, whereupon the fixing means are tightened. The car is lifted to the highest position, in which it is locked by the bars 24 of the locking rod. Requisite dismantling of the car is done prior to any rectifying work. Those of the driving plates 14 are removed which are considered necessary (with a view to the rectifying work). The rectifying table 12, to which the car has been fastened, is next lowered. This lowering takes place by first raising the rectifying table 12 until the locking rod is released. The locking is kept open until the table 12 is in its lowest position. Next, the rectifying unit 40 is connected to the rectifying table 12, in the beams 12*a* on its end.

If required, the unit 40 may be mounted on either end of the rectifying table. The rectifying head 80 is mounted on the unit 40 and on its frame portion 70, in the recess 71*a*,71*b* or 71*c* for the rectifying head 80. The rectifying head 80 is next moved to the point where the bottom beam of the car is angulated, by pushing the beam set in the transversal direction, i.e., in the direction of the Y axis and in the longitudinal direction by pulling the rectifying unit 40 while it is carried by its supporting wheels, until the rectifying head 80 is in register with the angulated point, where it may further be fixed using the gripping member 81.

The screw 51 is then tightened, which secures the beam set portion 70 to the frame portion 42 of the rectifying unit 40. While this is being done, the rectifying head 80 remains stationary and serves as a stay when the car body is being rectified at various points. The rectifying movement is obtained from the turning table 60 when to the turning table 60 is fitted the chain 100 with its fixing elements and the chain is carried over the trundles 94*a* and/or 94*b* of the rectifying jib 90 to the point where rectifying is to be done. The turning table 60 works with the aid of a hydraulic cylinder, one end of said cylinder 47 being attached to the turning table 60 and the other end to the beam 46, to its end plate 46*b*. The beam 46 is secured with the clamping screw 51 to the beam 43 of the rectifying unit 40. The rectifying unit 43 operates in rectifying work both on the chassis and upper structures of the car. It may also be installed on the rear end of the turning table 12. With the rectifying unit 40, provided with a rectifying head 80, the frame structures of a car can be rectified, and the chassis structures of the car in the longitudinal, transversal as well as height directions, i.e., the rectifying head 80, its gripping member, is movable in the directions $S_1$, $S_2$, $S_3$, $S_4$, $S_5$ and $S_6$. In FIG. 4, with the means of the invention the staying required in the rectifying work can also be accomplished, as has been presented as an example with the aid of FIG. 10.

Rectifying in longitudinal direction is done as follows. The turning table is first locked with the locking pin 66. The cylinder 47 is used to push the beam 46 in the direction of arrow L4 while the rectifying head 80 is against the transversal beam of the car. When the end plate 46*b* of the beam 46 has reached the transversal beam 12*b* of the rectifying table 12, this movement caused by the cylinder 47 stops and the cylinder 47 begins to act with force on the transversal beam of the car with the aid of the rectifying head 80. When the desired pressing force has been achieved, locking of the beam 46 to the beam 43 may be performed by tightening the screw 51 or equivalent. In this way the cylinder 47 can further be set free to serve in other rectifying work while the rectifying head 80 at the same time gives support to the transversal frame beam of the car in said manner, with the pressing force that has been set.

The rectifying unit 40 can be moved freely relative to the rectifying table 12 of the rectifying means 10, so that the rectifying unit 40 can be moved in the direction of its longitudinal axis and the longitudinal axis x of the rectifying means. The beams connected to the beams 43 are disposed to move telescopically relative to the beams $12a_1$, $12a_2$ of the rectifying table 12.

Lateral rectifying proceeds as follows. The locking pin 66 is first removed. The beams 43 and 46 are then already locked with reference to each other with the aid of the clamp screw 51. Next, the end 64*a* of the rod 64 is installed with the aid of a cotter pin 64 or another equivalent means in the hole 73 in the frame portion 70. The rod 64 is so attached at both ends that turning motion is allowed at both ends of the rod 64 in relation to the fixing points of said ends. Next, the hydraulic pressure in the cylinder 47 is lowered. As in the example of FIG. 4, the hydrauilc cylinder then rotates the turning plate in the direction of arrow L1, whereby the frame portion 70 moves in the direction of arrow L2. The rectifying head 80 mounted on the sliding beam set 70 will then move in the direction of said arrow L2 (FIG. 4).

Rectifying of the chassis structure in vertical direction is accomplished with the rectifying head 80. The rectifying head 80 carries a gripping member 81, which can with screw action be fixed to the car's chassis structures. The rectifying head 80 is used to lift or lower the car frame. When the gripping member 81 has been fixed to the edge of the car's frame, one of the two nuts 88 is turned in the slackening direction and the other nut 89 in the opposite direction, whereby the screw or threaded rod 85 moves upward and moves the inner jib 82 with gripping member 81 upward, and when it is desired that the car frame moves downward, said nuts are turned in opposite direction.

It is thus not intended to restrict the invention exclusively to the above-described most advantageous embodiments of the invention. The embodiment depicted in FIG. 11 is also conceivable, in which a rectifying unit according to the invention has been connected with sliding arrangement (arrow L11) with reference to the frame 110 of the stationary rectifying means. It is then possible in said embodiment to utilize the lifting motion of the shearlegs mechanism in the rectifying work itself. A relative movement (arrow L10) is then obtained in the vertical direction between the rectifying unit 40 and the rectifying table 12. In this embodiment, too, the rectifying unit 40 may be connected to either end of the stationary frame 110 detachably, and said rectifying unit 40 has been disposed to move in the beams 110*a* of the stationary frame 110, advantageously in telescopic fashion. The coupling with the fixed frame portion 110 may be substantially like that in the first embodiment already described, where the rectifying unit has been attached to the rectifying table 12 itself. The legs 110*b* of the stationary frame 110 may be changeable in length for conveying the unit 40 into position, the legs 110*b* having then a length such that the unit 40 can be pushed, on the wheels 130*b*,130*a*, to slide in the frame 110 fixed in relation to the rectifying table 12. Arrows L11 indicate the sliding of the unit 40 relative to the frame 110.

Figure 12:
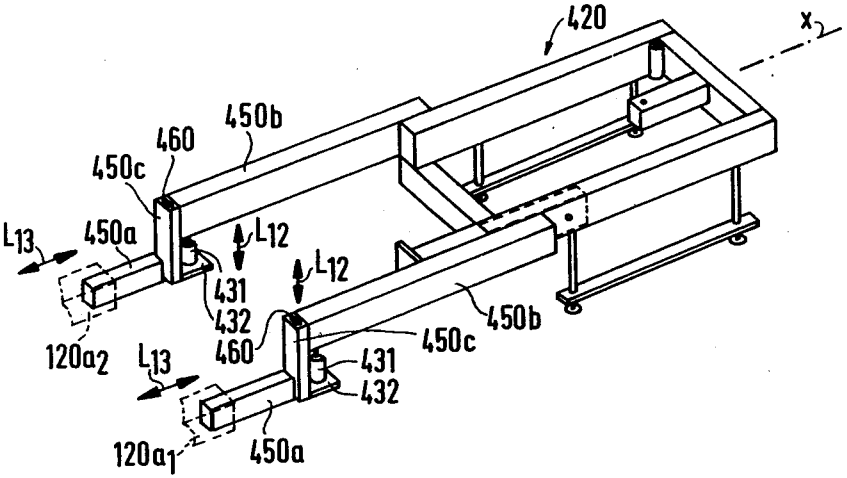
FIG. 12 is presented a third advantageous embodiment of the invention in axonometric projection. This illustrates the vertical separate movement arrangements of the rectifying unit.

The embodiment depicted in FIG. 12 is also conceivable, in which the rectifying unit has been connected, fitted to slide (arrows L13), to the rectifying table 12 itself or to the frame portion connected therewith and moving therewith, or in which the rectifying unit has been connected with sliding arrangement to the stationary frame 110, and in which embodiment independent possibility of vertical movement of the rectifying unit has been enabled. Then, for instance, the beams 450 of the first frame portion 420 of the rectifying unit 40 may be composed of two separate portions. Between said portions 450 is provided a juncture which enables vertical movement of one of the two beam portions 450 together with the rest of the rectifying unit relative to the other beam portion 450, which has been slidably connected to the frame 11 of the rectifying means 10 or to the lifting table 12. The first frame portion 420 of the unit 40 (FIG. 12) may be constructed so that the beam 450 consists of two portions 450*a* and 450*b*. The beam 450*b* together with the frame portion thereto connected has been disposed to move vertically (arrows L12) in the guide 450*c*, which may comprise for instance a swallow-tail juncture 460. The action means 431, advantageously a hydraulic cylinder, has been disposed to become coupled with the support lug 432 connected with the beam 450*a*, and with the beam 450*b*. The action means 431 have been arranged to effect the lifting and lowering movement of said rectifying unit 40. As shown in FIG. 12, there may be two action means 431. Also such an embodiment is conceivable in which only one action means 431 is used.

I claim:

1. Apparatus for rectifying an object comprising a rectifying unit couplable to a frame supporting a rectifying table which is mounted on the frame for movement in a substantially vertical direction and on which the object can be positioned, or couplable to the rectifying table itself, said rectifying unit comprising a first frame portion and a second frame portion movably disposed with respect to said first frame portion, a turning plate rotatably mounted on said first frame portion about a shaft thereof, action means for actuating the rotating movement of the turning plate, and means connected to said apparatus for directing rectifying forces on the object to be rectified in both substantially horizontal and vertical directions.

2. The combination of claim 1, wherein the object to be rectified is a vehicle, and additionally comprising means for securing the vehicle onto the rectifying table, whereby rectifying work can be performed both on frame beams and body structure of the vehicle.

3. The combination of claim 1, wherein said action means comprise a single actuating cylinder for directing the rectifying force on the object.

4. The combination of claim 3, additionally comprising an arm pivotally mountable on said turning plate and on said second frame portion, whereby rotation of said turning plate additionally moves said second frame portion substantially perpendicularly with respect to said first frame portion.

5. The combination of claim 4, wherein said first frame portion is mounted for movement in a substantially longitudinal direction, and said second frame portion is mounted for movement in a substantially transverse direction to said longitudinal direction.

6. The combination of claim 5, wherein said turning plate comprises a plurality of receiving recesses for receiving an end of said arm.

7. The combination of claim 6, wherein said turning plate comprises several recesses, each disposed at a different radius with respect to the turning shaft of said plate.

8. The combination of claim 5, wherein said first frame portion is mountable in longitudinal beams of the rectifying table or of the frame, for movement with respect thereto in a direction of a substantially longitudinal direction of the rectifying table.

9. The combination of claim 3, wherein said single actuating cylinder is an hydraulic cylinder pivotally coupled at one end thereof to said turning plate and at an opposite end thereof to a sliding beam of said first frame portion.

10. The combination of claim 9, wherein said first frame portion additionally comprises at least one beam slidably mounted in a complementary beam of the rectifying table or of the frame.

11. The combination of claim 9, wherein said first frame portion additionally comprises an outer complementary beam in which said slidable beam is fixable in various positions.

12. The combination of claim 11, wherein said first frame portion additionally comprises a beam connected to said outer complementary beam and telescopically disposed for movement in a respective beam of the rectifying table or frame, whereby the rectifying unit is mounted for movement in a substantially longitudinal direction of the rectifying table.

13. The combination of claim 3, wherein said actuating cylinder is a double-acting hydraulic cylinder.

14. The combination of claim 1, wherein said turning plate is substantially circular and is located substantially in a plane of the rectifying table.

15. The combination of claim 1, wherein said second frame portion comprises at least one receiving recess for a separate, vertically-positionable rectifying head.

16. The combination of claim 1, additionally comprising, an end unit couplable to said first or second frame portions and disposed to be movable in the substantially horizontal direction about an axle.

17. The combination of claim 16, wherein said end unit additionally comprises at least one substantially horizontal beam, at least one substantially vertical beam, and at least one guide roller on said vertical beam over which said means for directing comprises a rope or chain disposed with one end thereof coupled to said turning plate and the other end couplable to the object to be rectified.

18. The combination of claim 1, additionally comprising means for fixing said second frame portion in various positions with respect to said first frame portion, said second frame portion being slidable with respect to said first frame portion.

19. The combination of claim 18, wherein said fixing means comprise a clamp, a flat iron bar, or a screw.

20. The combination of claim 1, additionally comprising means for moving both said frame portions substantially vertically with respect to the rectifying table or the frame.

21. The combination of claim 1, wherein said rectifying unit is couplable to the frame and additionally comprising wheels on said unit for sliding said unit into and out of engagement with the frame, whereby lifting motion of the table can be utilized in rectifying work itself.

22. The combination of claim 1, wherein said first frame portion is additionally movable in the substantially vertical direction.

* * * * *